US005110112A

United States Patent [19]

Henn et al.

[11] Patent Number: 5,110,112

[45] Date of Patent: May 5, 1992

[54] DEVICE FOR CATCHING A TRAILING EDGE OF A SHEET FOR A SHEET DELIVERY

[75] Inventors: Manfred Henn, Heidelberg; Carsten Kelm, Mannheim, both of Fed. Rep. of Germany

[73] Assignee: Heidelberger Druckmaschinen AG, Heidelberg, Fed. Rep. of Germany

[21] Appl. No.: 613,383

[22] Filed: Nov. 15, 1990

[30] Foreign Application Priority Data

Nov. 15, 1989 [DE] Fed. Rep. of Germany ..... 3937945

[51] Int. Cl.[5] ..... B65H 31/32

[52] U.S. Cl. ..... 271/189; 271/183; 271/218

[58] Field of Search ..... 271/189, 218, 183

[56] References Cited

U.S. PATENT DOCUMENTS

| | | | |
|---|---|---|---|
| 2,699,943 | 1/1955 | Neri | 271/189 |
| 3,059,923 | 10/1962 | Pfeffer | 271/189 |
| 3,419,266 | 12/1968 | Martin . | |
| 3,966,195 | 6/1976 | Simeth . | |
| 4,469,321 | 9/1984 | Geschwindner . | |

FOREIGN PATENT DOCUMENTS

| | | | |
|---|---|---|---|
| 1230810 | 12/1966 | Fed. Rep. of Germany | 271/218 |
| 2549201 | 5/1976 | Fed. Rep. of Germany . | |
| 2935710 | 12/1981 | Fed. Rep. of Germany . | |
| 2310219 | 12/1976 | France . | |
| 555372 | 1/1957 | Italy | 271/189 |

*Primary Examiner*—Richard A. Schacher

*Attorney, Agent, or Firm*—Herbert L. Lerner; Laurence A. Greenberg

[57] ABSTRACT

A device for collecting a trailing edge of a sheet for a sheet delivery with a non-step auxiliary piling device in a sheet-fed rotary printing machine includes a plurality of collecting fingers all disposed at the same level at distances mutually spaced from one another, a motorized drive for moving the collecting fingers forwards and backwards, parallel to sheet travel, in a guide channel, a suction roller in operative proximity with the collecting fingers, and sheet pile stops for the trailing edges of the sheets, the sheet pile stops extending upwardly beyond the level of the sheet pile to the suction roller, the collecting fingers being disposed beneath the suction roller and between the pile stops, the motorized drive including a common drive member with mechanical transmission members coupled with the collecting fingers.

4 Claims, 2 Drawing Sheets

DEVICE FOR CATCHING A TRAILING EDGE OF A SHEET FOR A SHEET DELIVERY

Figure 1:
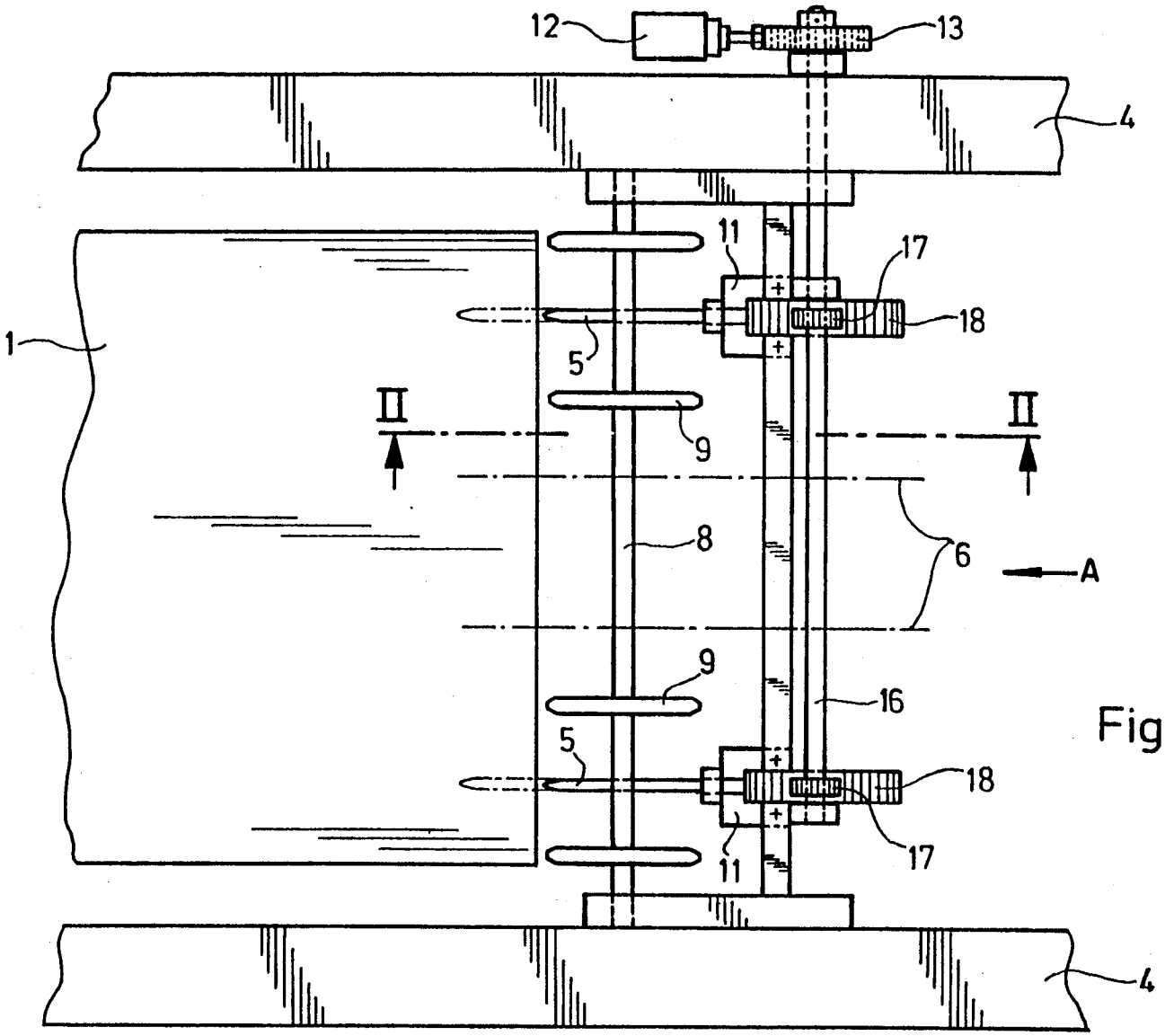

The invention relates to a device for catching or collecting a trailing edge of a sheet for a sheet delivery with a non-stop auxiliary sheet piling device or stacker in sheet-fed rotary printing machines.

The state of the art according to German Published Non-Prosecuted Application (DE-OS) 23 01 840 is representative of the foregoing type of device. This publication discloses an auxiliary piling device or stacker operating in connection with a suction roller for the non-stop operation of a sheet-fed rotary printing machine, with an auxiliary sheet piling or stacking board or table, catching or collecting fingers with stops for the leading edge of a sheet, and catching or collecting fingers for the trailing edge of the sheet which are insertable towards one another into the pile or stack region for the purpose of exchanging the pile while the printing machine is running, so that oncoming or arriving sheets are laid down or delivered on these catching or collecting fingers, and the auxiliary pile board or table can be inserted in a direction opposite to the direction of sheet travel, with the result that the board or table receives the sheets arriving during the pile exchange. With respect to the aforementioned heretoforeknown device, each catching or collecting finger has its own motor drive formed of a pneumatic or air cylinder with a piston and separate air hoses, the latter being laid along paths of different length in the machine. To move the catching or collecting fingers in rhythm with the operating cycle of the auxiliary stacker or piling device, a control device constructed for this purpose is required. To avoid the backsliding of oncoming sheets as they are being piled on the auxiliary piling table or board, the latter is insertable into the machine beyond the sheet pile.

With regard to an auxiliary stack or piling unit according to German Patent (DE-PS) 31 12 558, the collecting fingers are formed as angle brackets having respectively different leg or side lengths so selected that they fold away only as a result of the weight of several sheets which are laid thereon. These angle brackets achieve their active function by the lowering or reduction of the sheet pile.

From German Patent (DE-PS) 29 35 710, stops for trailing edges of sheets in a sheet pile have become known heretofore in connection with an auxiliary piling unit or stacker, the stops extending downwards from a suction roller as far as the upper region of the sheet pile. To form the auxiliary pile, in the device heretoforeknown from this reference, telescopically extensible arms are provided, which are extensible in the direction of sheet travel over the entire length of the pile during the pile exchange, so that an auxiliary pile forms on these arms, and the main pile can thereby be exchanged. In the reverse direction of movement, the auxiliary pile is removed again, the sheets accumulated or collected therein being deposited on the main pile. The long extension path determines the operating speed of this device.

It is accordingly an object of the invention to provide a device of the foregoing general type for collecting the trailing edge of a sheet having an improved reliability of operation when compared with conventional devices of this general type, and which is capable of operating with as little consumption of air a possible.

With the foregoing and other objects in view, there is provided, in accordance with the invention, a device for catching or collecting a trailing edge of a sheet for a sheet delivery with a non-stop auxiliary piling device in a sheet-fed rotary printing machine, comprising a plurality of catching or collecting fingers all disposed at the same level at distances mutually spaced from one another, motorized drive means for moving the collecting fingers forward and backward, parallel to sheet travel, in a guide channel, a suction roller in operative proximity with the collecting fingers, and sheet pile stops for the trailing edges of the sheets, said sheet pile stops extending upwardly beyond the level of the sheet pile to the suction roller, the collecting fingers being disposed beneath the suction roller and between the pile stops, the motorized drive means comprising a common drive member with mechanical transmission members coupled with the collecting fingers.

A synchronism in the movement of the collecting fingers for the trailing edge of the sheet is thereby achieved, because the movement of all of the collecting fingers originates from one common drive element, the movement of which is transmitted to the collecting fingers by means of mechanical transmission members. The method of construction thereof is very simple. No air hoses need be laid inside the machine, a fact which represents a considerable advantage over prior art devices because of the limited amount of construction space in the machine. The drive element is located laterally outside the machine and may, if necessary or desirable, be formed, in a conventional manner, of an air cylinder which, however, has a considerably lower air consumption when compared with the state of the art. Due to the fact that the collecting fingers are arranged beneath the suction roller between pile stops for the trailing edge of the sheets arriving in the auxiliary pile, the backsliding of sheets into the machine is avoided.

In accordance with another feature of the invention, the collecting device includes guiding blocks fixed on the machine, the collecting fingers being individually guidingly received in the guiding blocks, and the transmission members including a drive shaft mounted axially parallel with the suction roller, respective pinions mounted in fixed mutually spaced positions on the drive shaft, and respective toothed racks connected to the collecting fingers and respectively meshing with the pinions.

In accordance with a further feature of the invention, an end of the drive shaft protrudes out of the machine, and the motorized drive means are operatively connected to the drive shaft at the protruding end thereof for turning the drive shaft in working rhythm with the auxiliary piling device.

In accordance with a concomitant feature of the invention, the motorized drive means comprise a pneumatic piston-cylinder unit having a piston rod connected to the piston of the unit and a toothed rack carried by the piston rod, and including a pinion mounted on the drive shaft at the protruding end thereof, and gear transmission means meshingly interconnecting the toothed rack and the pinion mounted at the protruding end of the drive shaft.

Other features which are considered as characteristic for the invention are set forth in the appended claims.

Although the invention is illustrated and described herein as embodied in a device for catching or collecting trailing edges of sheets in a delivery of a sheet-fed rotary printing machine, it is nevertheless not intended to be limited to the details shown, since various modifications and structural changes may be made therein without departing from the spirit of the invention and within the scope and range of equivalents of the claims.

Figure 2:
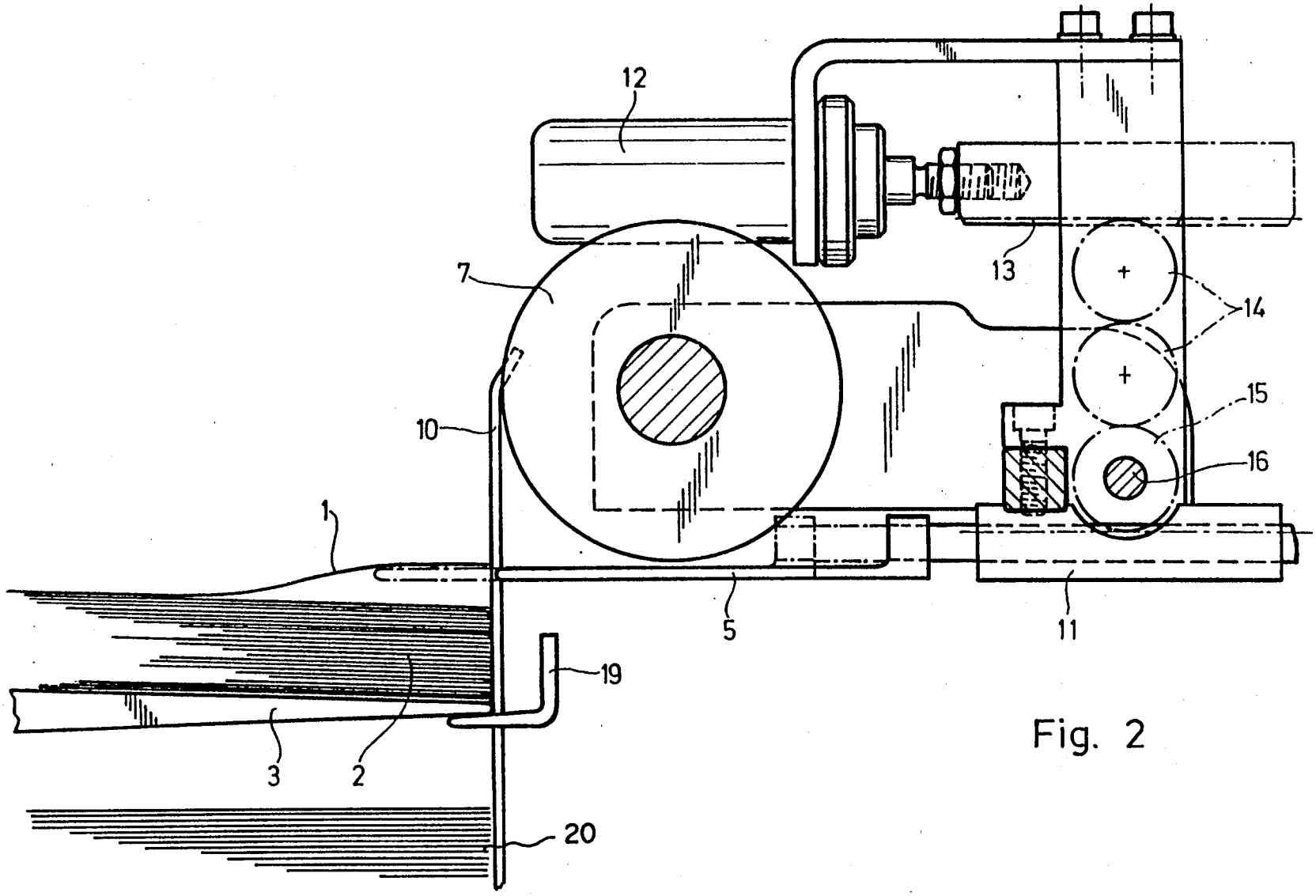

The construction of the invention, however, together with additional objects and advantages thereof will be best understood from the following description of the specific embodiment when read in connection with the accompanying drawings in which:

FIG. 1 is a diagrammatic top plan view of a device for catching or collecting trailing edges of sheets in a delivery of a sheet-fed rotary printing machine, in accordance with the invention;

FIG. 2 is an enlarged cross-sectional view of FIG. 1 taken along the line II—II in the direction of the arrows. p Referring now to the figures of the drawing, there is shown therein a device for catching or collecting the trailing edge of a sheet to be assigned to an auxiliary pile support device or stacker in a delivery of a sheet-fed rotary printing machine installed for non-stop operation. For the purpose of changing the pile, oncoming sheets 1 are collected in an auxiliary pile on a rack or board 3 inserted in a direction opposite to the direction of sheet travel represented by the arrow A. The device for catching or collecting a sheet trailing or rear edge is formed of several catching or collecting fingers 5, disposed adjacent to and spaced from one another and mounted in a frame 4 of the printing machine so as to be reciprocable parallel to the sheet 1, only the two outer collecting fingers 5 being shown in FIG. 1. Between these two outer collecting fingers 5, other collecting fingers can be provided, for example in the positions indicated by the dot-dash lines 6. The collecting fingers 5 are movable in a common plane beneath a suction roller 7, which is formed of a shaft 8 having ends which are journaled in the frame 4, and a plurality of disks 9 fastened thereon at mutually spaced distances from one another, and can be of conventional construction. Vertically extending stop bars 10 are positioned for the trailing or rear edge of the sheet 1 in the auxiliary pile or stack 2 and extend downwardly to the vicinity of a main sheet pile 20 and upwardly to between the disks 9 of the suction roller 7, so that the rear or trailing edges of the sheets coming on via the suction roller 7 arrive in front of the stops 10, and the sheets cannot slip back into the machine.

The horizontal movement of the collecting fingers 5 is guided in a sliding block 11 fixed on the frame 4. For the drive, a joint drive element is provided, which is formed, in the illustrated embodiment of the invention, for example, of an air cylinder 12 positioned outside of the frame 4. The air cylinder 12 has a piston which is connected to a toothed rack 13, which acts via a toothed gearing 14 upon a pinion 15, which is fastened onto a shaft 16 mounted in the machine parallel to the suction roller 8. The shaft 16 extends transversely across all of the collecting fingers 5 and, for each catching finger 5, is provided with a further pinion 17 having a toothing which meshes with a toothed rack 18, which is firmly connected, respectively, with one of the collecting fingers 5. In this way, the forward and backward movement of the collecting fingers 5 by means of the air cylinder 12 is controllable by a drive positioned outside of the machine.

The withdrawn final position of the collecting fingers 5 is represented in the drawing in solid lines. In order to insert the rack 3 to form an auxiliary sheet pile 2 during a pile exchange, the collecting fingers 5 are pushed forward into the phantom position thereof represented by dot-dash lines, so that as the rack 3 is inserted in a direction opposite to the direction of paper sheet travel, spearing actions in the vicinity of the rear or trailing edges of the sheets are avoided, such as those which have occurred frequently in the past, especially in the case of large paper formats. At the same time, sheets from the auxiliary pile are prevented from slipping back into the machine. Particular advantage attaches to a construction wherein the tips of the rack 3 are supported, during the formation of the auxiliary pile, on special stops 19, which are fastened in the machine. The construction and positioning of these stops 19 are not a part of the invention of the instant application, however.

The foregoing is a description corresponding in substance to German Application P 39 37 945.0, dated Nov. 15, 1989, the International priority of which is being claimed for the instant application, and which is hereby made part of this application. Any material discrepancies between the foregoing specification and the aforementioned corresponding German application are to be resolved in favor of the latter.

We claim:

1. In a sheet delivery of a sheet-fed rotary printing machine having a non-stop auxiliary piling device including an auxiliary pile support having a length at least equal to the length of the sheets being delivered, a device for collecting a trailing edge of the sheets, comprising a plurality of collecting fingers having a length which is a minor fraction of the length of the auxiliary pile support and being all disposed at an even level above the auxiliary pile support at distances mutually spaced from one another, motorized drive means for moving said collecting fingers forwards and backwards, parallel to sheet travel, in a guide channel, a suction roller in operative proximity with said collecting fingers, and sheet pile stops for the trailing edges of the sheets, said sheet pile stops extending upwardly beyond the level of said sheet pile to said suction roller, said collecting fingers being disposed beneath said suction roller and between said pile stops, said motorized drive means comprising a common drive member with mechanical transmission members coupled with said collecting fingers.

2. Collecting device according to claim 1, including guiding blocks fixed on the machine, said collecting fingers being individually guidingly received in said guiding blocks, and said transmission members including a drive shaft mounted axially parallel with said suction roller, respective pinions mounted in fixed mutually spaced positions on said drive shaft, and respective toothed racks connected to said collecting fingers and respectively meshing with said pinions.

3. Collecting device according to claim 2, wherein an end of said drive shaft protrudes out of the machine, and said motorized drive means are operatively connected to said drive shaft at said protruding end thereof for turning said drive shaft in working rhythm with the auxiliary piling device.

4. Collecting device according to claim 3, wherein said motorized drive means comprise a pneumatic piston-cylinder unit having a piston rod connected to the piston of said unit and a toothed rack carried by said piston rod, and including a pinion mounted on said drive shaft at said protruding end thereof, and gear transmission means meshingly interconnecting said toothed rack and said pinion mounted at said protruding end of said drive shaft.

* * * * *